US008793902B2

(12) United States Patent
Besanceney, III et al.

(10) Patent No.: US 8,793,902 B2
(45) Date of Patent: Aug. 5, 2014

(54) FOOTWEAR HAVING WATERPROOF VAPOR-PERMEABLE SOLE AND SOCKLINER FOR SAME

(75) Inventors: Henry A. Besanceney, III, New York, NY (US); Alberto Del Biondi, Padua (IT); John F. Ludemann, Southport, ME (US)

(73) Assignee: Nine West Development Corporation, Wilmington, DE (US)

( * ) Notice: Subject to any disclaimer, the term of this patent is extended or adjusted under 35 U.S.C. 154(b) by 792 days.

(21) Appl. No.: 13/004,002

(22) Filed: Jan. 10, 2011

(65) Prior Publication Data

US 2012/0174444 A1 Jul. 12, 2012

(51) Int. Cl.

| | |
|---|---|
| ***A43B 7/06*** | (2006.01) |
| ***A43B 13/14*** | (2006.01) |
| ***A43B 7/08*** | (2006.01) |
| ***A43B 13/12*** | (2006.01) |
| ***A43B 17/08*** | (2006.01) |

(52) U.S. Cl.

CPC ..... *A43B 7/088* (2013.01); *A43B 7/087* (2013.01); *A43B 13/127* (2013.01); *A43B 13/125* (2013.01); *A43B 17/08* (2013.01)

USPC ..... 36/3 B; 36/30 R

(58) Field of Classification Search

CPC ..... A43B 7/088; A43B 7/087; A43B 7/127; A43B 7/08; A43B 7/081; A43B 7/082; A43B 7/084; A43B 7/125; A43B 13/125; A43B 13/12; A43B 13/17; A43B 17/08; A43B 17/00

USPC ..... 36/3 B, 30 R, 4, 25 R

See application file for complete search history.

(56) References Cited

U.S. PATENT DOCUMENTS

| | | | | |
|---|---|---|---|---|
| 5,367,788 | A * | 11/1994 | Chen | 36/3 B |
| 5,371,957 | A | 12/1994 | Gaudio | |
| 5,588,226 | A | 12/1996 | Schenkel | |
| 5,675,914 | A * | 10/1997 | Cintron | 36/3 B |
| 5,983,524 | A | 11/1999 | Polegato | |
| 5,992,052 | A | 11/1999 | Moretti | |
| 6,038,790 | A | 3/2000 | Pyle et al. | |
| D422,780 | S | 4/2000 | Aguerre | |
| 6,092,305 | A | 7/2000 | Troy et al. | |
| D429,552 | S | 8/2000 | Kern | |
| 6,282,813 | B1 | 9/2001 | Squadroni | |
| 6,389,711 | B1 | 5/2002 | Polegato | |
| 6,408,541 | B1 | 6/2002 | Moretti | |
| 6,604,302 | B2 | 8/2003 | Polegato Moretti | |
| 6,655,048 | B2 | 12/2003 | Moretti | |
| 6,681,500 | B2 | 1/2004 | Moretti | |
| 6,823,609 | B2 | 11/2004 | Moretti | |
| 6,839,984 | B2 | 1/2005 | Polegato | |

(Continued)

*Primary Examiner* — Ted Kavanaugh
(74) *Attorney, Agent, or Firm* — Senniger Powers LLP

(57) ABSTRACT

Footwear including an upper sized and shaped for covering a human foot of a predetermined size. The upper has a lower edge defining a lower boundary of the upper and an upper edge defining an opening through which the foot is inserted when positioning the footwear on the foot. A waterproof vapor-permeable sheet having an outer edge defining a shape corresponding to the foot is stitched to the lower edge of the upper. An interior surface of the upper and an upper surface of the sheet define an interior of the footwear into which the foot is inserted, with the upper surface of the sheet forming a bottom surface of the interior of the footwear.

25 Claims, 5 Drawing Sheets

(56) References Cited

U.S. PATENT DOCUMENTS

| | | | | |
|---|---|---|---|---|
| 6,874,251 | B2 | 4/2005 | Moretti | |
| 6,904,705 | B2 | 6/2005 | Polegato Moretti | |
| D507,863 | S | 8/2005 | McClaskie | |
| 6,948,260 | B2 * | 9/2005 | Lin et al. | 36/3 B |
| D511,608 | S | 11/2005 | Carnes | |
| D513,111 | S | 12/2005 | Caine | |
| 7,017,284 | B2 | 3/2006 | Keidel et al. | |
| 7,096,604 | B2 | 8/2006 | Polegato Moretti | |
| D544,183 | S | 6/2007 | Hull | |
| 7,284,342 | B2 * | 10/2007 | Avent et al. | 36/44 |
| 7,367,141 | B2 | 5/2008 | Polegato Moretti | |
| 7,370,382 | B2 | 5/2008 | Polegato Moretti | |
| D593,290 | S | 6/2009 | Chen | |
| 7,546,697 | B2 | 6/2009 | Polegato Moretti | |
| 7,559,157 | B2 | 7/2009 | Polegato Moretti | |
| D608,999 | S | 2/2010 | McClaskie | |
| 7,716,851 | B2 | 5/2010 | Polegato Moretti | |
| 7,793,426 | B2 | 9/2010 | Byrne et al. | |
| 7,823,297 | B2 | 11/2010 | Polegato Moretti | |
| D636,570 | S | 4/2011 | Merritt et al. | |
| D637,803 | S | 5/2011 | Alvear et al. | |
| D642,775 | S | 8/2011 | Raysse | |
| D645,240 | S | 9/2011 | McClaskie | |
| D650,566 | S | 12/2011 | Yamashita et al. | |
| D650,567 | S | 12/2011 | Badegruber | |
| D657,945 | S | 4/2012 | Oberschneider | |
| D659,963 | S | 5/2012 | Merritt et al. | |
| D664,754 | S | 8/2012 | Klein et al. | |
| D665,566 | S | 8/2012 | Klein et al. | |
| D668,854 | S | 10/2012 | Dean et al. | |
| 2005/0000117 | A1 | 1/2005 | Polegato Moretti | |
| 2005/0241082 | A1 | 11/2005 | Moretti | |
| 2006/0168846 | A1 * | 8/2006 | Juan | 36/3 B |
| 2008/0216358 | A1 | 9/2008 | Polegato Moretti | |
| 2009/0188134 | A1 | 7/2009 | Polegato Moretti | |
| 2009/0193690 | A1 | 8/2009 | Moretti | |
| 2009/0199438 | A1 | 8/2009 | Polegato Moretti | |
| 2009/0211119 | A1 | 8/2009 | Moretti | |
| 2009/0277047 | A1 | 11/2009 | Polegato Moretti | |
| 2010/0011624 | A1 | 1/2010 | Polegato Moretti | |
| 2010/0050480 | A1 | 3/2010 | Polegato Moretti | |
| 2010/0132228 | A1 | 6/2010 | Polegato Moretti | |
| 2011/0061269 | A1 * | 3/2011 | Nakano | 36/3 A |
| 2011/0113649 | A1 | 5/2011 | Merritt et al. | |
| 2011/0185593 | A1 | 8/2011 | Ramos | |
| 2012/0005920 | A1 | 1/2012 | Alvear et al. | |
| 2012/0047770 | A1 | 3/2012 | Dean et al. | |
| 2012/0174444 | A1 | 7/2012 | Besanceney, III et al. | |
| 2013/0232824 | A1 * | 9/2013 | Bier et al. | 36/3 A |
| 2013/0247414 | A1 * | 9/2013 | Bier et al. | 36/45 |

* cited by examiner

FOOTWEAR HAVING WATERPROOF VAPOR-PERMEABLE SOLE AND SOCKLINER FOR SAME

BACKGROUND OF THE INVENTION

The present invention relates to footwear, and more particularly, to footwear having a waterproof vapor-permeable sole to cool a wearer's foot during use while maintaining a waterproof shoe.

Footwear must be ventilated to remove heat and perspiration. Feet generate heat during activities such as running and aerobic exercise. As with other parts of the body, the feet sweat when they become overheated. When people wear footwear, the heat and perspiration are unable to escape freely, causing the feet to remain hot and damp. This condition can cause the wearer some discomfort and if not reduced or eliminated can lead to other problems including blistering and athletes foot. Thus, there is a need to ventilate footwear to remove heat and perspiration. One problem with ventilating footwear, however, is maintaining waterproof footwear so water outside the footwear, such as from puddles, does not enter the footwear thereby increasing rather than decreasing dampness. Accordingly, there is a need to remove heat and dampness from footwear without permitting liquid to enter the footwear.

SUMMARY OF THE INVENTION

In one aspect, the present invention is directed to footwear generally including an upper sized and shaped for covering a human foot of a predetermined size. The upper has a lower edge defining a lower boundary of the upper and an upper edge defining an opening through which the foot is inserted when positioning the footwear on the foot. A waterproof vapor-permeable sheet having an outer edge defining a shape corresponding to the foot is stitched to the lower edge of the upper. An interior surface of the upper and an upper surface of the sheet define an interior of the footwear into which the foot is inserted, with the upper surface of the sheet forming a bottom surface of the interior of the footwear.

In another aspect, the invention is directed to footwear generally including an upper sized and shaped for covering a human foot of a predetermined size. The upper has a lower edge defining a lower boundary of the upper and an upper edge defining an opening through which the foot is inserted when positioning the footwear on the foot. A compliant sole is attached to the upper. The compliant sole has a sidewall, a lower surface forming an exterior bottom surface of the footwear, and an upper surface opposite the lower surface. The upper surface has elongate channels extending laterally across the upper surface. The sidewall has ports permitting air to flow between the elongate channels and an ambient atmosphere outside the sole. Each of the channels has a width greater than that of the corresponding port. A waterproof vapor-permeable sheet overlies the compliant sole.

In yet another aspect, the invention includes an upper sized and shaped for covering a human foot of a predetermined size. The upper has a lower edge defining a lower boundary of the upper and an upper edge defining an opening through which the foot is inserted when positioning the footwear on the foot. A compliant sole is attached to the upper. The compliant sole has a sidewall, a lower surface forming an exterior bottom surface of the footwear, and an upper surface opposite the lower surface. The upper surface has elongate channels extending laterally across the upper surface. Each of the channels has a cross section that varies along a length of the respective channel. The sidewall has ports permitting air to flow between the elongate channels and an ambient atmosphere outside the sole. A waterproof vapor-permeable sheet overlies the compliant sole.

In still another aspect, the invention is directed to a sockliner for insertion into an interior of footwear to provide a base upon which a foot rests when inserted in the footwear. The sockliner generally includes an upper surface and a lower surface opposite the upper surface. The lower surface includes a groove having at least a portion extending longitudinally along the lower surface and following at least a portion of a perimeter of the lower surface. The sockliner has perforations extending through the sockliner from the groove in the lower surface to the upper surface for directing air through the sockliner.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE PREFERRED EMBODIMENTS

Figure 1:
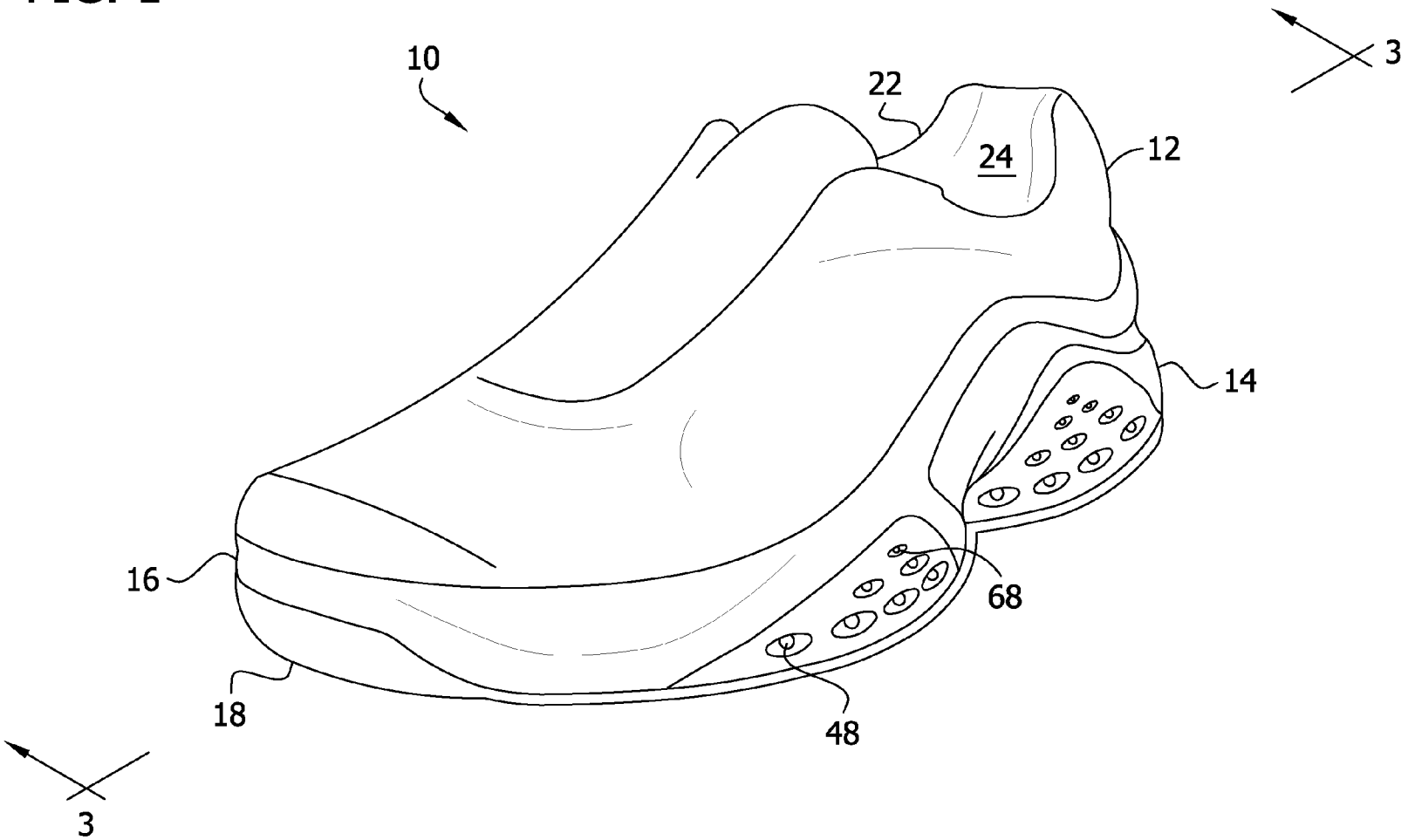
FIG. 1 is a perspective of footwear according to the present invention.

Referring to FIG. 1, footwear of the present invention is generally designated in its entirety by the reference number 10. The footwear 10 comprises an upper 12 and a sole 14. In some embodiments, the sole 14 includes multiple layers. For example, in the illustrated embodiment shown in FIG. 2, the sole 14 consists of a midsole 16 and an outsole 18.

Figure 2:
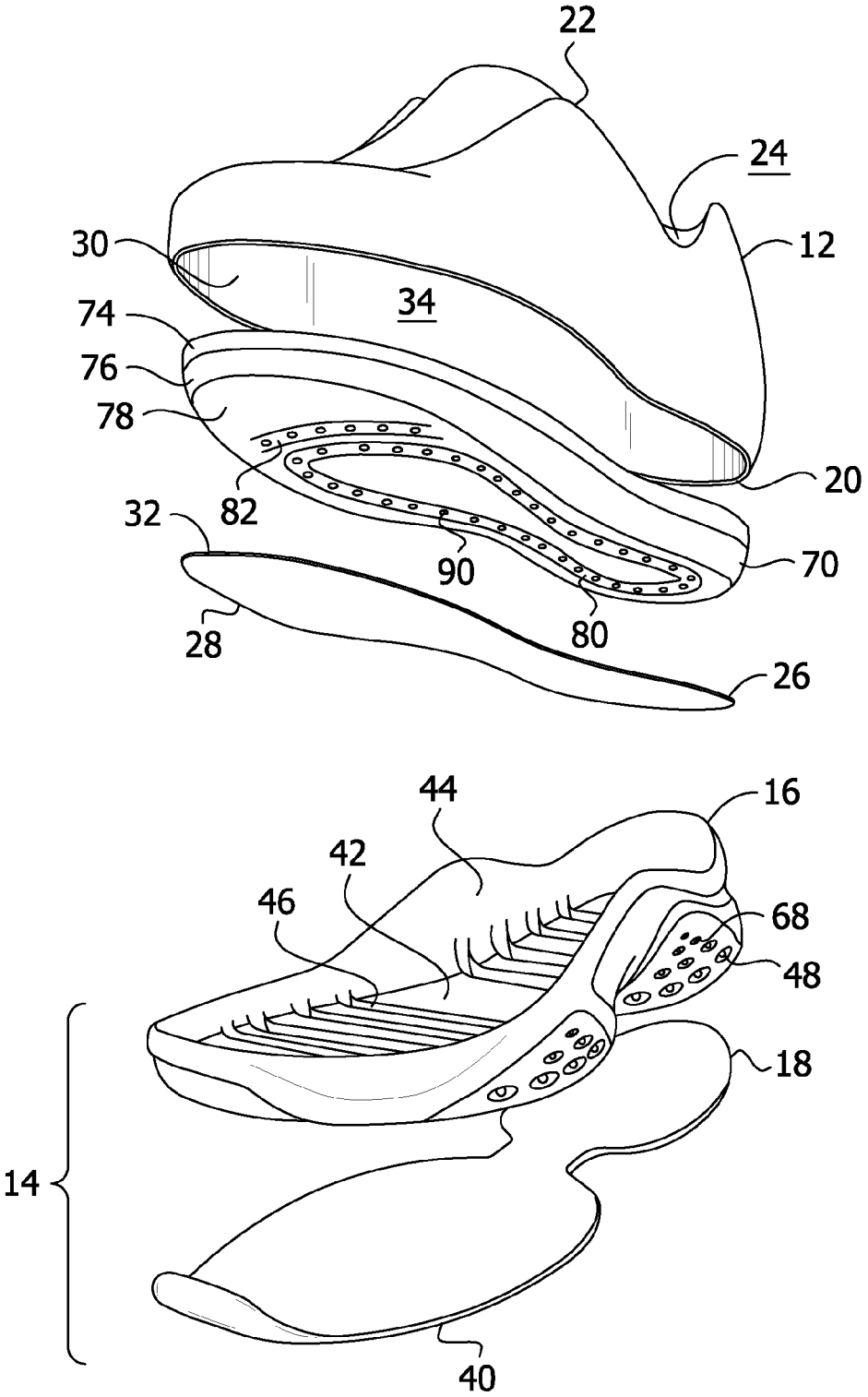
FIG. 2 is a separated view thereof.

The upper 12 is preferably made of a conventional footwear material. In some embodiments, the upper 12 is made of a vapor-permeable material. Other materials known in the art may be used without departing from the scope of this invention. The upper 12 is sized and shaped for covering a human foot of a predetermined size. As shown in FIG. 2, a lower edge 20 defines a lower boundary of the upper 12, and an upper edge 22 defines an opening 24 through which a foot is inserted when the footwear 10 is in use. The upper 12 includes a conventional closure (not shown) such as lacing, buckles, or hook and loop fasteners. Because the upper is conventional, it will not be described in further detail.

In the embodiment illustrated in FIG. 2, the upper 12 is strobel lasted to a waterproof vapor-permeable membrane 26 so a margin adjacent an outer edge 28 of the membrane is stitched to a margin adjacent the lower edge 20 of the upper. Although the waterproof vapor-permeable membrane may be made of other materials without departing from the scope of the present invention, in one embodiment the waterproof vapor-permeable membrane comprises layered woven and non-woven fabric treated with waterproofing that permits vapor to pass. As strobel lasting is well known in the art, it will not be described in further detail. Although strobel lasting is used to attach the upper 12 to the membrane 26 in the illustrated embodiment, it is believed that other conventional methods may be used without departing from the scope of the present invention. As will be appreciated by those skilled in the art, the outer edge 28 of the membrane 26 is generally sized and shaped to correspond to the shape of a foot and a conventional footwear size (e.g., 8C). An inner surface 30 of the upper 12 and an upper surface 32 of the membrane 26 define an interior 34 of the footwear 10 into which a wearer's foot is inserted during use. The membrane 26 preferably allows air to flow through the membrane in both directions, but prevents liquids such as water in puddles from passing upward through the membrane into the interior 34 of the footwear.

As shown in FIG. 2, the sole 14 in one embodiment is formed from multiple layers, including the midsole 16 and the outsole 18. Both the midsole 16 and the outsole 18 are generally shaped to correspond to the shape of a foot. In one embodiment, the midsole 16 is bonded to the membrane 26 and/or the upper 12 using adhesives. Other suitable means such as vulcanizing may be used to attach the midsole 16 to the membrane 26 or the upper 12. Likewise, in some embodiments, the outsole 18 is bonded to the midsole 16 using adhesives or vulcanization. The midsole 16 is preferably constructed of a closed cell polymer foam that provides cushioning and shock absorption to the foot. One such foam is elon, which is commonly available to those skilled in the art. A lower surface of the outsole 18 forms the exterior bottom surface 40 of the footwear 10. Thus, the outsole 18 is preferably constructed of a durable polymer capable of withstanding abrasions during use.

Figure 4:
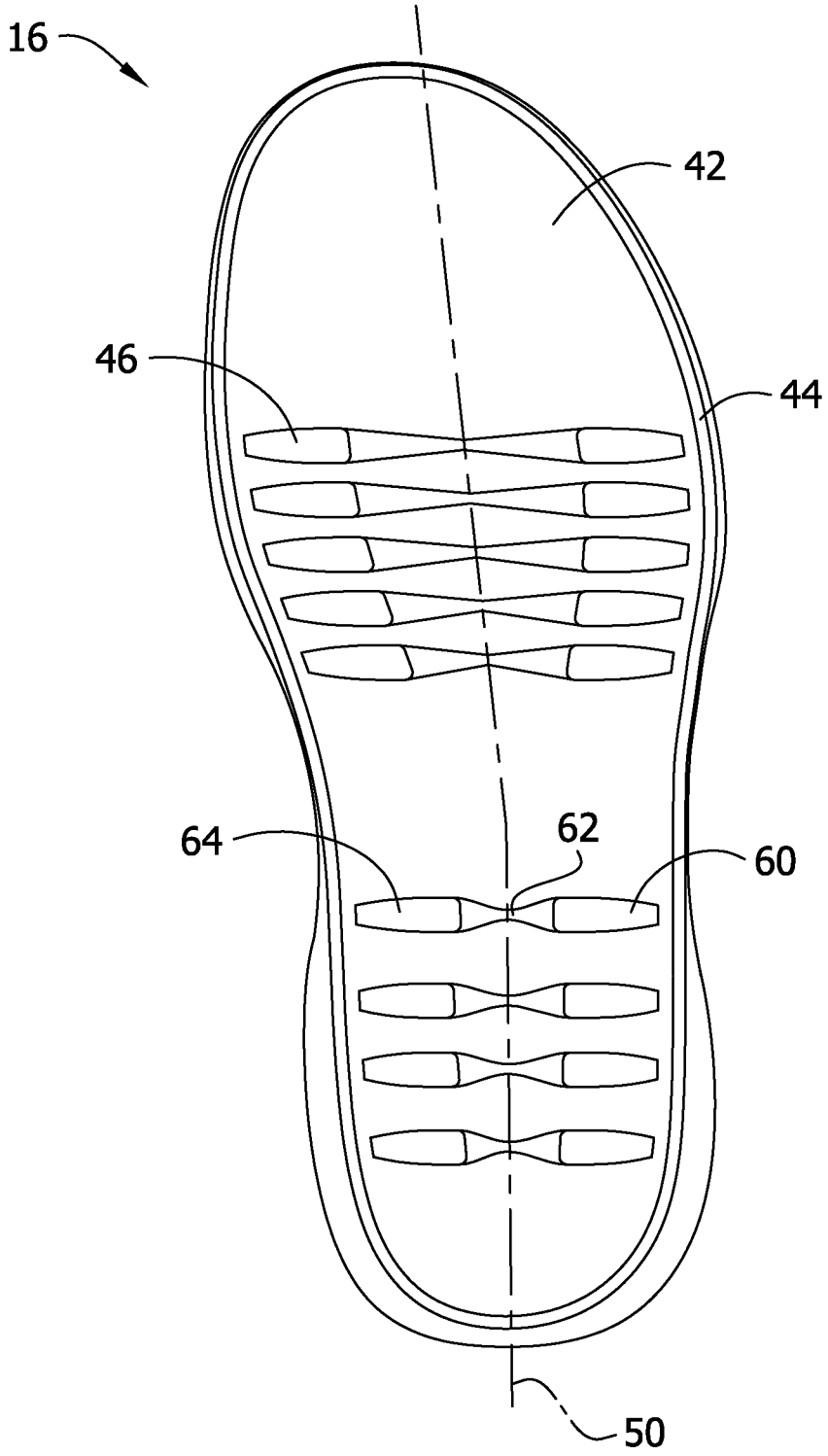
FIG. 4 is a top plan of a sole having ports and elongate channels allowing fluid flow through the sole.

As illustrated in FIG. 4, the midsole 16 includes an upper surface 42 and a sidewall 44 extending around a perimeter of the upper surface. The upper surface 42 includes a plurality of elongate channels 46 extending laterally across the upper surface 42. The channels 46 in one embodiment extend parallel to each other as shown. The sidewall 44 has a plurality of ports 48 positioned along the sides of the footwear 10. The ports 48 are aligned with respective channels 46 so air can travel from outside the footwear 10 into the channels and vice versa. It should be noted that adhesives and other treatments that would block airflow through the membrane 26 are not used above the channels 46 so that air is free to flow from the channels through the membrane.

In some embodiments, the channels 46 each have a cross section that varies along its length. In general, the channel cross sections become smaller toward a longitudinal centerline 50 of the midsole 16. As will be understood by those skilled in the art, the tapered configuration provides additional support for the heel of the foot. Thus, each channel 46 is relatively wider along a first portion 60 adjacent sidewall 44, relatively narrower along a second portion 62 near the longitudinal centerline 50 of the midsole 16, and then relatively wider along a third portion 64 adjacent to the sidewall on an opposite side of the longitudinal axis from the first portion. In the illustrated embodiment, the first and third portions 60, 64 of the elongate channels 46 are also relatively deeper than the second portion 62. As illustrated, the central portion of the midsole 16 that is positioned for underlying an arch of the foot can be devoid of elongate channels 46 to provide support to the wear's arch. Other configurations of elongate channels are envisioned as being within the scope of the present invention.

The ports 48 extend generally horizontally through the sidewalls 44. As previously mentioned, each port 48 communicates with one of the elongate channels 46 to permit air to flow between the elongate channels and an ambient atmosphere outside the sole. In one embodiment, one port 48 is generally aligned with each end of every elongate channel 46 such that every elongate channel is in communication with and extends between two ports. Other configurations of ports and channels, however, are within the scope of the present invention. In some embodiments, the ports 48 have a diameter of less than about 4 mm, and more preferably have a diameter of about 1.5 mm. As illustrated in the drawings, the ports 48 may have tapered entries that smooth airflow through the ports. Further, the midsole 16 may include dimples 68 mimicking the ports 48 to visually cue wearers to the benefits available from the unusual construction of the midsole.

Figure 3:
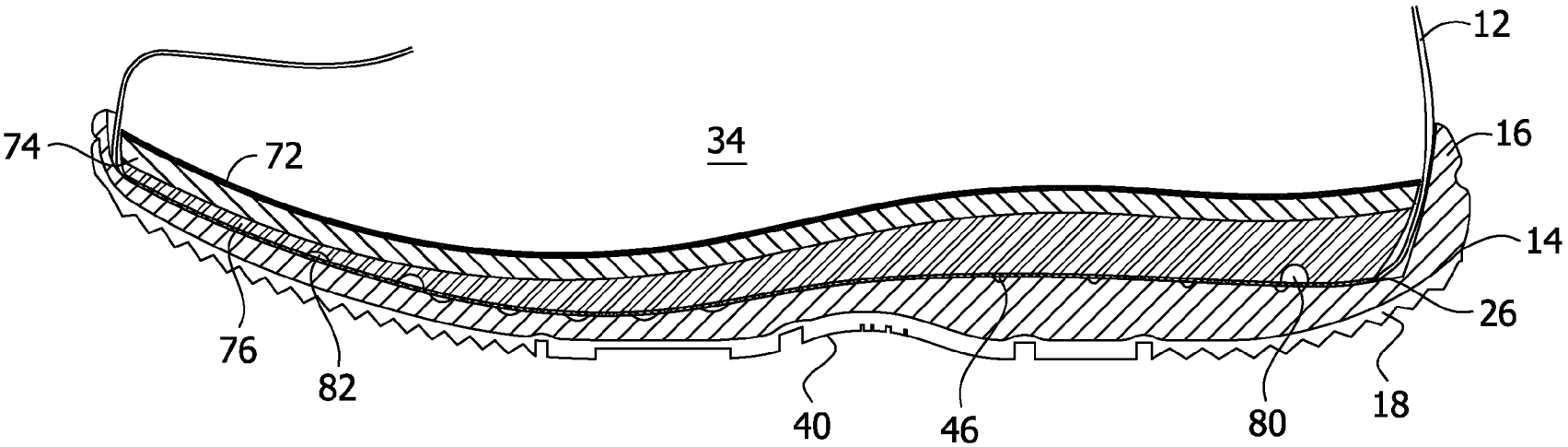
FIG. 3 is a sectional view of the footwear taken along line 3-3 of FIG. 1.
Figure 5:
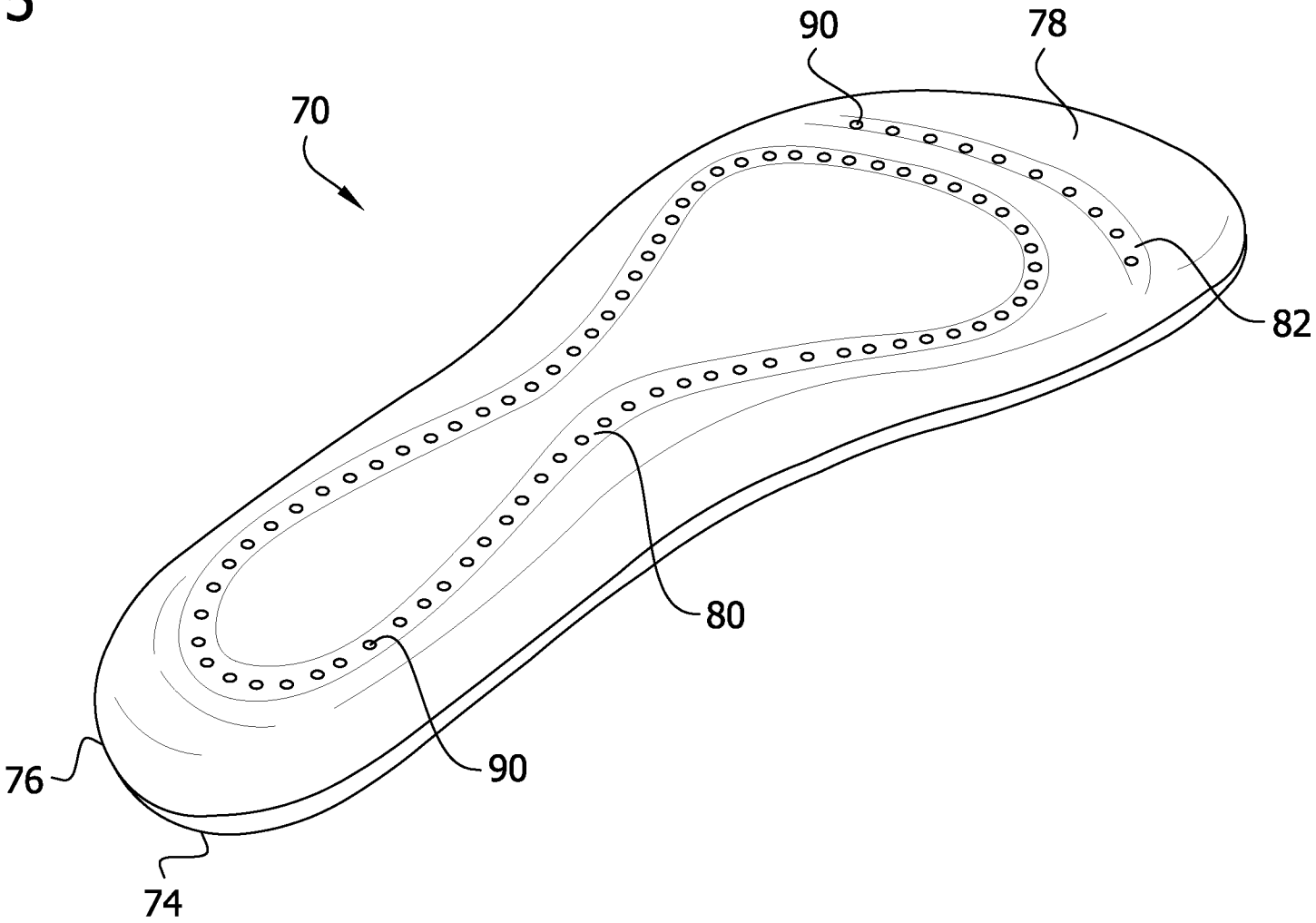
FIG. 5 is a bottom perspective of a sockliner having a groove and perforations allowing fluid flow through the sockliner.

The footwear 10 also includes a removable sockliner 70 inserted in the interior 34 of the footwear on top of membrane 26. The sockliner 70 is generally shaped to correspond to the shape of a foot. As illustrated in FIG. 3, the sockliner 70 in one embodiment includes multiple layers. For example, an upper layer 72 may include a fabric such as carrera available from Faytex, a middle layer 74 may include slow recovery open-cell polyurethane foam, and a lower layer 76 may include closed-cell foam. As will be appreciated by those skilled in the art, a fabric upper layer 72 provides an attractive and smooth surface for the wearer. The slow recovery open cell foam middle layer 74 dampens shock and thermally insulates the wearer from heat generated by cyclically compressing the closed cell lower layer 76. The closed cell lower layer 76 provides cushioning. As illustrated in FIG. 5, a lower surface 78 of the sockliner 70 includes a groove 80 generally corresponding to a shape of a wearer's foot from the ball of the foot to the heel. Another groove 82 generally corresponds to the wearer's toes. The groove 80 extends generally longitudinally along the lower surface 78, and in some embodiments, the groove follows at least a portion of a perimeter of the lower surface. Perforations 90 extend upward from the grooves 80, 82, through all of the layers of the sockliner 70, to an upper surface 84 of the sockliner. In one embodiment, the perforations 90 are generally evenly spaced along each of the grooves 80, 82. The illustrated groove arrangement, however, provides a higher density of perforations 90 under the phalange or metatarsal heads of the wearer's foot to provide additional airflow and permit the sockliner 70 to preferentially flex under the corresponding joints of the foot.

In use, the footwear 10 permits air to travel through the ports 48 to the channels 46. Air travels along the channels 46 and upward through the vapor-permeable membrane 26 to the grooves 80, 82 in the lower surface 78 of the sockliner 70. Air traveling along the grooves 80, 82 turns and travels upward through the perforations 90 in the sockliner 70 where it flows over the surfaces of the wearer's foot. As the air travels over the foot, the surfaces are cooled and perspiration is carried upward where it can pass through the upper 12 or through the opening 24 at the top of the footwear 10. Further, air can travel in an opposite direction from the upper 12, through the sockliner 70, membrane 26, and midsole 16 to the ports 48. The membrane 26 allows air to pass through it but prevents water from passing. Thus, when a wearer steps in liquid such as a puddle, the liquid cannot pass through the membrane 26 to the interior 34 of the footwear 10.

Having described the invention in detail, it will be apparent that modifications and variations are possible without departing from the scope of the invention defined in the appended claims.

When introducing elements of the present invention or the preferred embodiments(s) thereof, the articles "a", "an", "the", and "said" are intended to mean that there are one or more of the elements. The terms "comprising", "including", and "having" are intended to be inclusive and mean that there may be additional elements other than the listed elements.

In view of the above, it will be seen that the several objects of the invention are achieved and other advantageous results attained.

As various changes could be made in the above constructions and methods without departing from the scope of the invention, it is intended that all matter contained in the above description and shown in the accompanying drawings shall be interpreted as illustrative and not in a limiting sense.

What is claimed is:

1. Footwear comprising:

an upper sized and shaped for covering a human foot of a predetermined size, said upper having a lower edge defining a lower boundary of the upper and an upper edge defining an opening through which the foot is inserted when positioning the footwear on the foot;

a unitary waterproof vapor-permeable sheet having an outer edge defining a shape corresponding to the foot stitched to the lower edge of the upper so that an interior surface of the upper and an upper surface of the sheet define an interior of the footwear into which the foot is inserted, said upper surface of the sheet forming a bottom surface of the interior of the footwear; and a compliant sole attached to the upper and extending below the waterproof vapor-permeable sheet, the sole extending longitudinally between a forefoot section positioned for underlying a forefoot of a wearer and a heel section positioned for underlying a heel of the wearer, said compliant sole having a sidewall, a lower surface forming an exterior bottom surface of the footwear, and an upper surface opposite the lower surface, the upper surface having elongate channels extending laterally across the upper surface, each of the channels having a width measured longitudinally with respect to the sole that varies along a length of the respective channel, and the sidewall having ports permitting air to flow between the elongate channels and an ambient atmosphere outside the sole.

2. Footwear as set forth in claim 1 wherein the sole comprises:

a compliant midsole forming the upper surface having the elongate channels and the sidewall having the ports; and a durable outsole including the lower surface forming the exterior bottom surface of the footwear.

3. Footwear as set forth in claim 1 wherein each of the elongate channels extending laterally across the upper surface of the sole has a cross section that varies along a length of the respective channel.

4. Footwear as set forth in claim 1 wherein a portion of the sole positioned for underlying an arch of the foot is devoid of elongate channels.

5. Footwear as set forth in claim 1 further comprising a sockliner having an upper surface and a lower surface opposite the upper surface, the lower surface including a groove that extends over more than one of the elongate channels extending laterally across the upper surface of the sole, the sockliner having perforations extending through the sockliner from the groove in the lower surface to the upper surface for directing air between the groove and the interior of the footwear.

6. Footwear as set forth in claim 5 wherein the perforations extending through the sockliner have a greater density in a portion of the sockliner adapted to underlie foot structures including at least one of a phalange and a metatarsal head than in at least some other portions of the sockliner.

7. Footwear as set forth in claim 6 wherein the sockliner comprises a layer of open cell foam overlying a layer of closed cell foam.

8. Footwear as set forth in claim 7 wherein the layer of open cell foam comprises slow recovery foam.

9. Footwear as set forth in claim 7 wherein the sockliner comprises cloth applied to an upper surface of the open cell foam.

10. Footwear comprising:

an upper sized and shaped for covering a human foot of a predetermined size, said upper having a lower edge defining a lower boundary of the upper and an upper edge defining an opening through which the foot is inserted when positioning the footwear on the foot;

a compliant sole attached to the upper having a sidewall, a lower surface forming an exterior bottom surface of the footwear, and an upper surface opposite the lower surface, the sole extending longitudinally between a forefoot section positioned for underlying a forefoot of a wearer and a heel section positioned for underlying a heel of the wearer, the upper surface having elongate channels extending laterally across the upper surface, and the sidewall having ports permitting air to flow between the elongate channels and an ambient atmosphere outside the sole, wherein each of the channels has a width measured longitudinally with respect to the sole, the width being greater than that of the corresponding port; and a waterproof vapor-permeable sheet overlying the compliant sole.

11. Footwear as set forth in claim 10 further comprising a sockliner positioned above the sheet to provide a base upon which a foot rests when inserted in the footwear, said sockliner comprising an upper surface and a lower surface opposite the upper surface including a groove having at least a portion extending longitudinally along the lower surface and following at least a portion of a perimeter of said lower surface, the sockliner having perforations extending through the sockliner from the groove in the lower surface to the upper surface for directing air through the sockliner.

12. Footwear as set forth in claim 10 wherein each of the channels has a height measured laterally with respect to the sole and the channels, the height being greater than that of the corresponding port.

13. Footwear as set forth in claim 10 wherein each of the elongate channels extends generally parallel to the other channels.

14. Footwear as set forth in claim 10 wherein each of the channels has a cross section that varies along a length of the respective channel.

15. Footwear as set forth in claim 14 wherein each of the elongate channels is deeper adjacent the sidewall than at its middle.

16. Footwear as set forth in claim 15 wherein each of the elongate channels is wider adjacent the sidewall than at its middle.

17. Footwear as set forth in claim 14 wherein each of the elongate channels is wider adjacent the sidewall than at its middle.

18. Footwear as set forth in claim 10 wherein a portion of the sole positioned for underlying an arch of the foot is devoid of elongate channels.

19. Footwear comprising:

an upper sized and shaped for covering a human foot of a predetermined size, said upper having a lower edge defining a lower boundary of the upper and an upper edge defining an opening through which the foot is inserted when positioning the footwear on the foot;

a compliant sole attached to the upper having a sidewall, a lower surface forming an exterior bottom surface of the footwear, and an upper surface opposite the lower surface, the sole extending longitudinally between a forefoot section positioned for underlying a forefoot of a wearer and a heel section positioned for underlying a heel of the wearer, the upper surface having elongate channels extending laterally across the upper surface, each of the channels having a width measured longitudinally with respect to the sole that varies along a length of the respective channel, and the sidewall having ports permitting air to flow between the elongate channels and an ambient atmosphere outside the sole; and a waterproof vapor-permeable sheet overlying the compliant sole.

20. Footwear as set forth in claim 19 further comprising a sockliner positioned above the sheet to provide a base upon which a foot rests when inserted in the footwear, said sockliner comprising an upper surface and a lower surface opposite the upper surface including a groove having at least a portion extending longitudinally along the lower surface and following at least a portion of a perimeter of said lower surface, the sockliner having perforations extending through the sockliner from the groove in the lower surface to the upper surface for directing air through the sockliner.

21. Footwear as set forth in claim 19 wherein each of the elongate channels is deeper adjacent the sidewall than at its middle.

22. Footwear as set forth in claim 19 wherein each of the elongate channels is wider adjacent the sidewall than at its middle.

23. Footwear as set forth in claim 19 wherein a portion of the sole positioned for underlying an arch of the foot is devoid of elongate channels.

24. Footwear as set forth in claim 1 further comprising a sockliner positioned on the upper surface of the sheet to provide a base upon which a foot rests when inserted in the footwear, said sockliner comprising an upper surface and a lower surface opposite the upper surface including a groove having at least a portion extending longitudinally along the lower surface and following at least a portion of a perimeter of said lower surface, the sockliner having perforations extending through the sockliner from the groove in the lower surface to the upper surface for directing air through the sockliner.

25. Footwear comprising:

an upper sized and shaped for covering a human foot of a predetermined size, said upper having a lower edge defining a lower boundary of the upper and an upper edge defining an opening through which the foot is inserted when positioning the footwear on the foot;

a compliant sole attached to the upper having a sidewall, a lower surface forming an exterior bottom surface of the footwear, and an upper surface opposite the lower surface, the upper surface having elongate channels extending laterally across the upper surface, each of the channels having a cross section that varies along a length of the respective channel, and the sidewall having ports permitting air to flow between the elongate channels and an ambient atmosphere outside the sole;

a waterproof vapor-permeable sheet overlying the compliant sole; and a sockliner positioned above the sheet to provide a base upon which a foot rests when inserted in the footwear, said sockliner comprising an upper surface and a lower surface opposite the upper surface including a groove having at least a portion extending longitudinally along the lower surface and following at least a portion of a perimeter of said lower surface, the sockliner having perforations extending through the sockliner from the groove in the lower surface to the upper surface for directing air through the sockliner.

* * * * *